US005620396A

United States Patent [19]

Westphal

[11] Patent Number: 5,620,396

[45] Date of Patent: Apr. 15, 1997

[54] TOY TUNNEL STRUCTURE

[76] Inventor: Mark E. Westphal, 106 Shelley La., Yardley, Pa. 19067

[21] Appl. No.: 293,544

[22] Filed: Aug. 22, 1994

[51] Int. Cl.[6] ..... A63B 9/00

[52] U.S. Cl. ..... 482/35; 482/148; 135/97

[58] Field of Search ..... 52/79.8, 63; 135/97, 135/128, 137, 143, 148, 150, 151, 152, 153, 117, 119; 472/92, 136, 35; 138/120, 150, 157; 454/187; 174/101; 482/35, 148

[56] References Cited

U.S. PATENT DOCUMENTS

| | | | |
|---|---|---|---|
| D. 291,717 | 9/1987 | Brooks | D21/242 |
| 2,047,748 | 7/1936 | Schmidt . | |
| 2,656,844 | 10/1953 | Kreuzer . | |
| 3,441,037 | 4/1969 | Transeau | 135/97 |
| 3,840,919 | 10/1974 | Middleton . | |
| 3,895,796 | 7/1975 | Pestalozzi . | |
| 4,556,391 | 12/1985 | Tardivel . | |
| 4,629,182 | 12/1986 | Rader . | |
| 4,649,947 | 3/1987 | Tury et al. | 135/97 |
| 4,757,832 | 7/1988 | Russel . | |
| 4,811,751 | 3/1989 | Maloney . | |
| 4,862,906 | 9/1989 | Jordon | 135/97 |
| 4,979,242 | 12/1990 | Maggio . | |
| 4,979,532 | 12/1990 | Johansson et al. | 135/97 |
| 5,069,623 | 12/1991 | Peat . | |
| 5,222,513 | 6/1993 | Hilliard | 135/97 |
| 5,277,349 | 1/1994 | Rowe . | |

*Primary Examiner*—Jerome Donnelly
*Attorney, Agent, or Firm*—LaMorte & Associates

[57] ABSTRACT

A tunnel play structure for a child's amusement comprised of at least one collapsible tunnel element made from flexible material surrounding a plurality of rigid framing supports. Each tunnel element is elongated having a closable entrance at either end. At least one closeable entrance is also disposed along the sides of the tunnel element in between the framing supports. The tunnel elements can be selectively joined together so that an entrance on one tunnel element aligns with an entrance on a second tunnel element. This enables a plurality of tunnel elements to be joined to create a continuous enclosure in a wide variety of configurations. Each tunnel element can also be collapsed in an accordion-like manner, thereby allowing the tunnel structures to be easily stored when not in use.

14 Claims, 3 Drawing Sheets

TOY TUNNEL STRUCTURE

BACKGROUND OF THE INVENTION

1. Field of the Invention

The present invention relates to toy tunnel structures used for the amusement of children, wherein the tunnels can be joined into various configurations through which children may crawl. More particularly, the present invention relates to collapsible material-based structures with rigid sub-frames used to create the toy tunnels.

2. Prior Art Statement

Young children are typically fond of tunnel like structures, such as large boxes, in which they may play. This preference is embodied in many playgrounds and parks where enclosed slides and tire tunnels are commonly constructed for the children's enjoyment. Recognizing the play value of tunnels, several toy tunnel structures have been developed in the prior art and marketed to children. Two such prior art toy tunnel structures are exemplified by U.S. Pat. No. 4,629,182 to Rader, entitled INFLATABLE TOY TUNNEL and U.S. Pat. No. 3,895,796 to Pestalozzi, entitled TOY AND SPORTS DEVICE. As is typical with such prior art toy tunnels, the tunnel structure only has openings at its two ends. Accordingly, to change the direction of the tunnel, differently angled tunnel components are joined end to end to create a single continuous tunnel. The amusement value of the tunnel quickly wanes as the children become familiar with the tunnel structure. The continuous structure of the toy tunnel also makes it very difficult to assemble the toy tunnel in a confined area or indoors.

A tunnel structure with much more entertainment value is a tunnel structure that a child can enter and exit at multiple points. As a result, more than one child can play with the tunnel at once, meeting at various points within the tunnel without concern about one child blocking another's passage.

Play structures with multiple entrances and exits have been limited mostly to playhouse structures and tents. See, for instance, U.S. Pat. No. 5,069,623 to Peat, entitled EDUCATION PLAY STRUCTURE. However, these devices do not form tunnel structures and cannot be coupled together to form tunnel structures.

The present invention is a material-based collapsible toy tunnel structure that not only has entrances at both ends, but also at multiple points in between both ends. Accordingly, several tunnel structures can be joined together in hundreds of differing configurations where any one tunnel can intercept another tunnel at any desired point. This creates a toy tunnel structure with multiple side tunnels which is more enjoyable to children and is easier to configure into a shape that can fit in a confined space such as a person's home.

SUMMARY

The present invention is a play tunnel structure for a child's amusement comprised of at least one collapsible tunnel element made from flexible material surrounding a plurality of rigid framing supports. Each tunnel element is elongated having a closable means of ingress at either end. At least one closeable means of ingress is also disposed along the sides of the tunnel element in between each of the framing supports. The tunnel elements can be selectively joined together so that the means of ingress on one tunnel element aligns with a means of ingress on a second element. This enables a plurality of tunnel elements to be joined to create a continuous enclosure in a wide variety of configurations.

The tunnel structures are preferably made of an air permeable material for safety and have a flat bottom to enable a child to easily crawl through the structure. Support brackets engage at least one of the framing supports in each tunnel, thereby preventing the tunnel from collapsing when being used. The support brackets can be selectively undone when not in use to enable the tunnel structures to collapse upon themselves for easy storage. The collapsible construction of the tunnel structures enables the tunnel structures to be quickly and easily set into position and taken down by either an adult or child.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE PRESENT INVENTION

Figure 1:
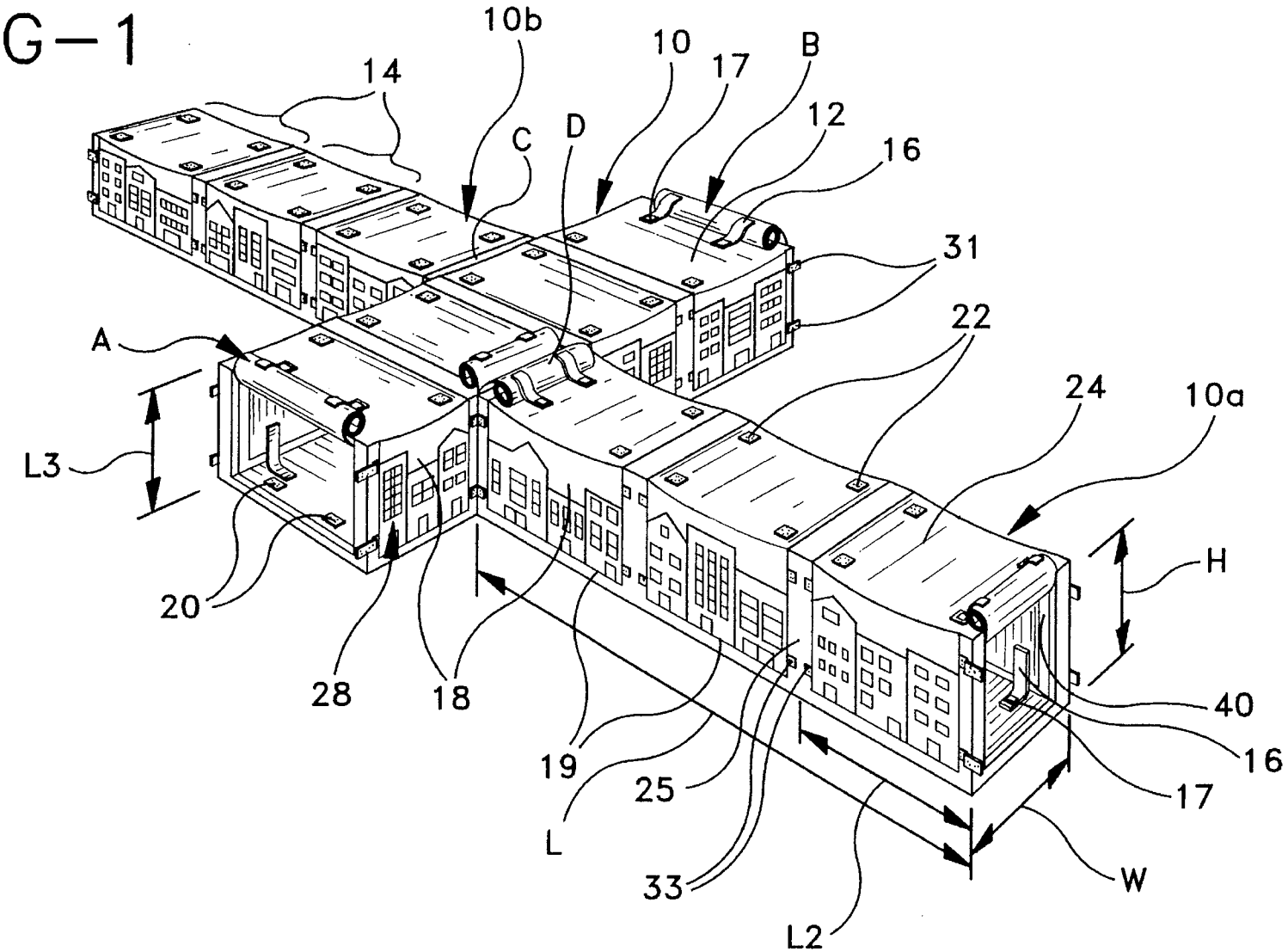
FIG. 1 is a perspective view of three tunnel structures made in accordance with one exemplary embodiment of the present invention.

Referring to FIG. 1, a first preferred embodiment of the present invention tunnel structure is shown. Each straight section of the shown embodiment represents a separate tunnel structure joined to other tunnel structures in a manner that will be later explained. In the shown embodiment, there is a primary tunnel structure 10 and two secondary tunnel structures 10*a*, 10*b* of similar construction to the primary tunnel structure 10 but of a shorter length. The secondary tunnel structures 10*a*, 10*b* extend at a perpendicular from points near the center of the primary tunnel structure 10 to present an exemplary embodiment, for the purposes of description only. As will be later explained, any number of tunnel structures may be joined in hundreds of different configurations. Each tunnel structure 10, 10*a*, 10*b* has a preferably square cross-sectional profile, however a rectangular, semi-circular or other shape that has at least one flat side may also be used. A shape having a flat side is preferred since it rests flush against the floor and it makes it easy for a child inside the tunnel structure to crawl across the bottom of the tunnel structure. In the shown embodiment, each tunnel structure has a height H of between 1.5 feet and 4 feet and a width W of between 1.5 feet and 4 feet, with the preferred dimensions being 2 feet by 2 feet.

Each tunnel structure 10, 10*a*, 10*b* is made of flexible material 12 suspended in between relatively rigid framing supports 40. The flexible material 12 is preferably an air permeable material such as canvas, however any other tear resistant material may be used. The use of an air permeable material is preferred to prevent a child from suffocating, should that child become entrapped in a collapsed tunnel structure.

Each tunnel structure 10, 10*a*, 10*b* has a plurality of segments 14 defined by how many framing supports 40 are used to create that tunnel structure. In the shown embodiment, the primary tunnel structure 10 has four segments, while the two secondary tunnel structures 10*a*, 10*b* each have three segments. Although the tunnel structures can have any length L, it is preferred that each tunnel structure have a length L of between 2 feet and 8 feet and each segment 14 in the tunnel structure have a length L2 of between 1.5 and 3 feet. A flap 18 is preferably present on either side of the tunnel structures 10, 10*a*, 10*b* in each of the segments 14. However, in larger tunnel structures, flaps may be formed in every other segment 14 or on alternate sides of each segment 14. The flaps 18 may be formed by simple cuts in the material 12 of the tunnel structure. However, in a preferred embodiment, the length L3 of each flap is longer than the opening that the flap 18 covers. As a result, the bottom edge 19 of each flap 18 hangs over the edge material at the bottom of the opening. Optional straps 16 with hook and loop fasteners 17, such as VELCRO, may be disposed on either the interior or exterior of each flap 18. A corresponding patch 20 of hook and loop fasteners may be disposed on the bottom or side of the tunnel structure proximate the bottom of the opening. Accordingly, the flaps 18 may be selectively joined in a closed position to the tunnel structure in a manner that is easily opened and closed by a child playing within the tunnel structure.

Patches 22 of hook and loop fasteners are also disposed on the top surface 24 of each of the tunnel structures 10, 10*a*, 10*b* above each of the flaps 18. These patches 22 allow the flaps 18 to be held in place when rolled up and flipped upwardly onto the top surface 24 of each of the tunnel structures 10, 10*a*, 10*b* as shown at points A and B. The same straps 16 used to hold the flap 18 in the closed position can couple to the patches 22 on the top surface 24 of the tunnel structure to hold the rolled-up flaps in place, thereby leaving open the entrance to the tunnel structure normally covered by the flap 18. The use of hook and loop fasteners as above described is merely exemplary, and it will be understood that any other type of fasteners, such as snaps, laces or the like may also be used.

In the preferred embodiment, the sides 25 of each of the tunnel structures 10, 10*a*, 10*b* are decorated with a mural 28. In the shown embodiment, the mural 28 is of a city skyline. However, any other amusing mural such as a jungle or a ship may also be used. Similarly, colorful murals may optionally be present on the interior surfaces of each of the tunnel structures 10, 10*a*, 10*b*.

In the shown embodiment, there are two smaller tunnel structures 10*a*, 10*b* coupled to the primary tunnel structure 10. It is intended that the present invention tunnel structures be made in a variety of lengths. Accordingly, the various tunnel structures can be aligned in hundreds of different orientations that would allow a parent or a child to use the tunnel structures to create a maze within their homes no matter what floor layout or furniture orientations they may have. In FIG. 1, it is seen that to join any two tunnel structures together, such as the primary tunnel structure 10 to the proximal secondary tunnel structure 10*a*, an opening on one tunnel structure need only be abutted against the opening on an adjacent tunnel structure. It will therefore be understood that tunnel structures may be aligned end-to-side as is shown or either end-to-end or side-to-side as is not shown. If the person assembling the tunnel structures together wants a flap 18 to be present in between the tunnel structures, one or both of the flaps in the area of abutment are left in the downward position. See position C where the distal secondary tunnel structure 10*b* abuts against the primary tunnel structure 10. A child within the tunnel structure could then push open the flap 18 as the child crawls from one tunnel structure to another. However, as is seen at position D, where the proximal secondary tunnel structure 10*a* abuts against the primary tunnel structure 10, the flaps 18 can be rolled up onto the top surfaces 24 of the tunnel structures. This provides an open passage from one tunnel structure to the next.

In one embodiment, separate tunnel structures need only be placed in abutment to create a desired tunnel orientation. However, to help keep separate tunnel structures together as children are crawling through them, optional joining means may be employed between adjacent tunnel structures. The optional joining means may be hook and loop fasteners disposed on the ends of each tunnel structure and around the openings on the sides of each tunnel structure. In the shown embodiment, short straps of material 31 are disposed on the sides 25 of the tunnel structures around each of the flaps 18. A patch of either a hook and loop fastener is positioned on the short strips of material 31. The opposite patch 33 of a hook and loop fastener is disposed on the sides of each tunnel at points corresponding to the strips of material 31. Accordingly, when the end of one tunnel structure is abutted against the side of another tunnel structure, the short strips of material 31 provide for easy alignment and easy attachment.

The described short strips of material 31 and hook and loop fasteners are only exemplary and represent a simple, cost effective way to attach adjacent tunnel structures together. However, any other means of attachment may also be used such as mechanical fasteners, laces, zippers and the like.

Figure 2:
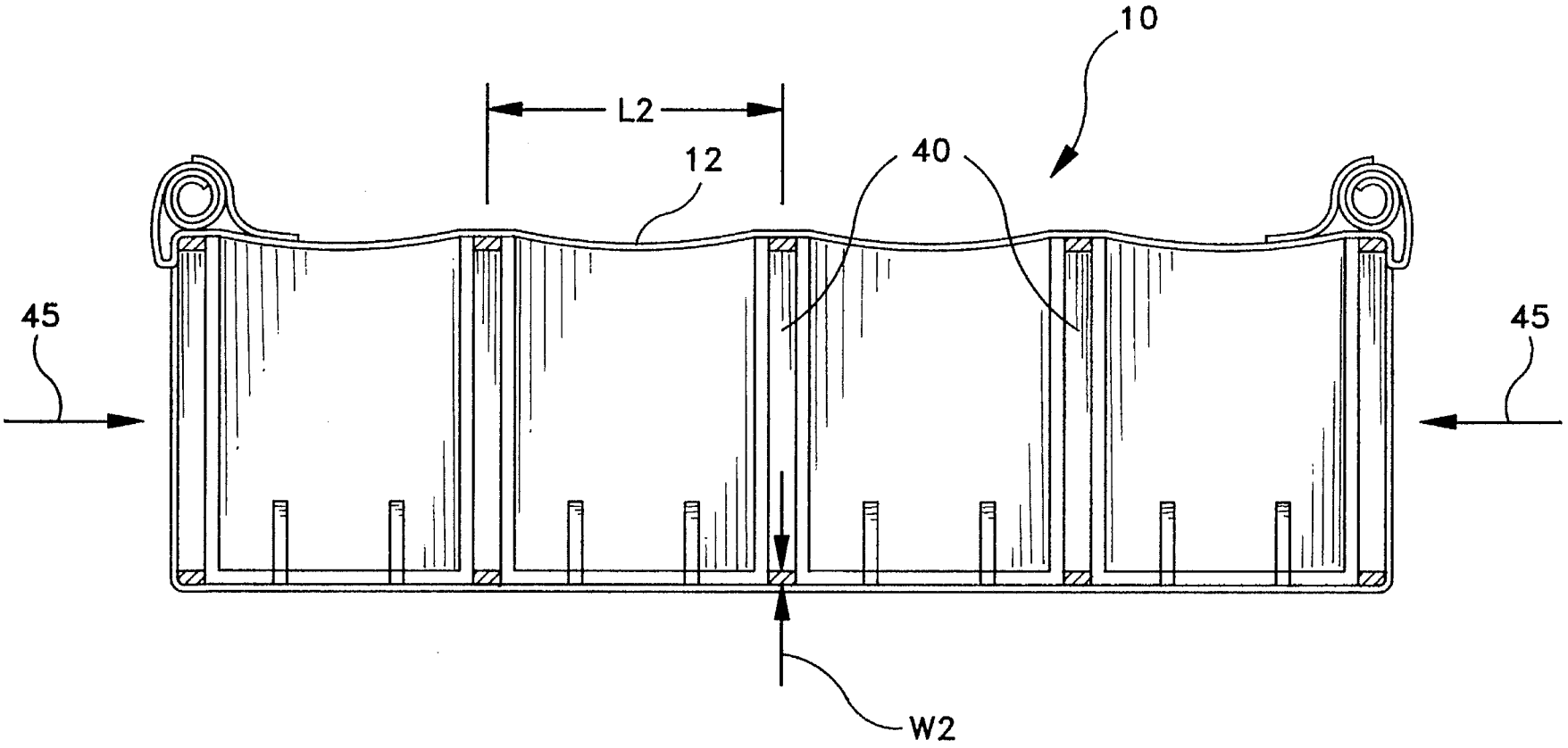
FIG. 2 is a cross-sectional view of the embodiment of FIG. 1, viewed along section line 2—2.

Referring to FIG. 2, there is shown a cross-section of the primary tunnel structure 10. As can be seen, the tunnel structure 10 is comprised of flexible material 12 supported by a plurality of framing supports 40. The framing supports 40 are preferably flat, having a narrow width W2 that is not awkward over which to crawl. The framing supports 40 may also have rounded edges to reduce knee pain and help prevent the flexible material 12 from tearing. The framing supports 40 are attached to the flexible material 12 in any conventional manner, i.e. any known adhesive or mechanical means. In the preferred embodiment, the flexible material 12 is permanently attached to the framing supports 40. However, the flexible material 12 may be made to be removable from the framing supports 40 to facilitate the washing of the flexible material 12 when dirty. The length L2 between adjacent framing supports 40 is preferably between one and a half feet and three feet depending upon the length of the tunnel structure 10 and the weight of the flexible material 12. In the shown embodiment, the framing supports 40 are not attached to each other. As a result, the entire tunnel structure 10 may collapse upon itself in an accordion fashion if compressed in the direction of arrows 45. If pulled taut in a direction opposite the arrows 45, the tautness of the flexible material 12 lets a person know when the tunnel structure 10 has been extended to its maximum length.

Figure 3:
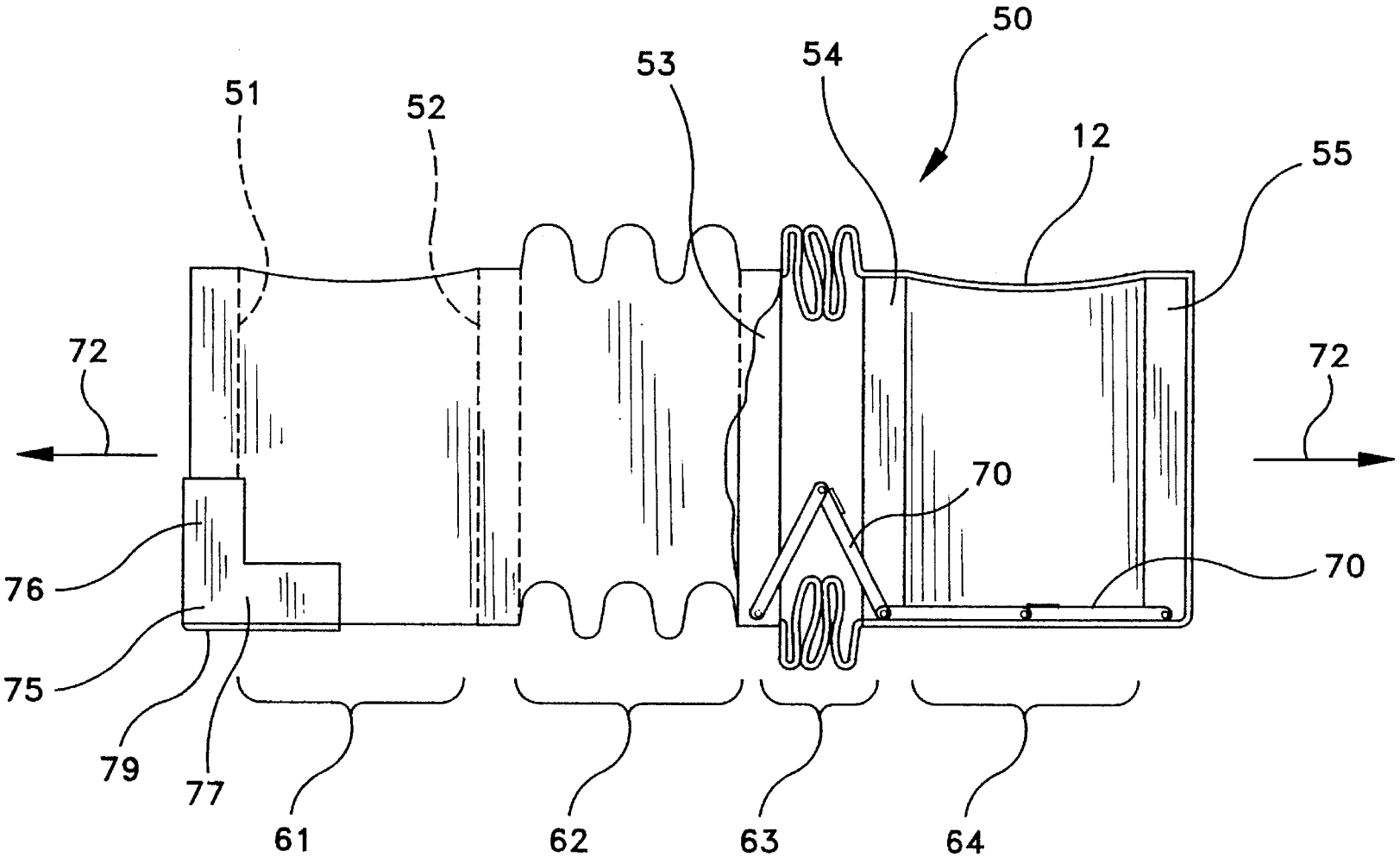
FIG. 3 is a side view of a tunnel structure having two alternate embodiments of a vertical support thereon, that act to retain the framing support elements of the tunnel structure in a generally vertical orientation.

Since the framing supports 40 extend vertically when the tunnel structure 10 is laying on the ground, some structure is needed to hold the framing supports 40 in a perpendicular relationship relative the ground, thereby preventing the tunnel structure from tilting or collapsing as a child is crawling through the tunnel structure. Referring to FIG. 3, two exemplary embodiments of a support means are shown. In FIG. 3, an exemplary tunnel structure 50 is shown having five framing supports 51, 52, 53, 54, 55 that define four separate segments 61, 62, 63, 64 along the length of the tunnel structure 50. In the shown embodiment, the flexible material 12 between the right end framing support 55 and the next subsequent framing support 54 is held taut by a linkage assembly 70 that holds the two framing supports 54, 55 a predetermined distance apart. When the linkage assembly 70 becomes straight, it locks into place, thereby rigidly connecting the two framing supports 54, 55 together. By virtue of the rigid connection, each framing support holds an adjacent framing support into the desired vertical orientation. Linkage assemblies 70 that lock when made straight are well known in the art and are used on many children's products such as playpens, strollers and the like. In between framing support 53 and framing support 54, the linkage assembly 70 is shown in its unlocked orientation. As can be ascertained, this allows adjacent framing supports to collapse against one another as the flexible material 12 folds up in an accordion-like manner.

In between framing support 52 and framing support 53, there is no interconnecting element other than the flexible material 12. As a result, the flexible material 12 will be taut if the overall tunnel structure 50 is pulled taut in the direction of arrows 72. Similarly, the two framing supports 52, 53 would collapse against each other if the overall tunnel structure 50 was compressed in the direction opposite arrows 72. The purpose of segment 62 is to explain that every framing support need not have a support means that holds it in a vertical position. Rather, if any two framing supports are held in the vertical position, any framing supports in between the supported framing supports will also stand in a generally vertical orientation since they are suspended between the supported framing supports by the flexible material 12. Accordingly, it should therefore be understood that only the end framing supports of a tunnel structure need to be supported, unless the tunnel structure is excessively long.

In FIG. 3, the left end framing support 51 is supported by an L-shaped bracket 75 that couples to the framing support 51 either on the exterior or the interior of the tunnel structure 50. In the shown embodiment, the L-shaped bracket 75 is on the exterior of the tunnel structure 50. The bracket 75 has a vertical section 76 that clamps onto the framing support 51. The clamping action can be from a movable fastener, however it is preferred that the clamping force is applied by a spring constant of the vertical section 76 itself as it is placed around the framing support 51. The horizontal section 77 of the L-shaped bracket 75 preferably has an elongated flat bottom 79 that acts as a platform base and supports the framing support 51 in the desired vertical orientation.

The described supports are only meant to be exemplary and any other known means of supporting the various framing supports may be used. For instance, in an alternative embodiment, flexible poles may be passed through apertures sewn into the tunnel structure. The poles may extend in between two rigid end frames thereby providing support to the entire tunnel structure. The use of flexible poles and similar structures are well known in the assembly of tents. Any such tent support structure may be adapted to the present invention tunnel structures.

Although the above described embodiments of the invention describe the best mode of the invention as derived by the inventor, it will be understood that a person skilled in the art of material clad structures could make modifications and variations to the described designs by utilizing functionally equivalent components, varying proportions and/or creating alternate configurations. All such modifications and alternate design choices are intended to be covered by the scope of this application as defined by the appended claims.

What is claimed is:

1. A toy tunnel structure, having a first end, a second end and a generally uniform tubular portion therebetween, said toy tunnel structure comprising:

a plurality of framing supports, wherein each of said framing supports defines an open central region;

flexible material surrounding said framing supports, joining said framing supports together and defining said generally tubular portion of said toy tunnel structure, said generally tubular portion including at least one section, wherein each said section has a height and width of between 1.5 feet and 4 feet and includes a bottom surface, a top surface and opposing side surfaces, that extend in between two of said framing supports; and at least one means of ingress disposed at said first end, at said second end and at each said side surface through which a child can enter and exit said tunnel structure, wherein each of said means of ingress is uniform in size.

2. The tunnel structure according to claim 1, wherein each of said framing supports includes two side elements and a top element that extends between said side elements; said tunnel structure further including support means for supporting at least one of said side elements in a generally vertical orientation.

3. The tunnel structure according to claim 1, wherein said tunnel structure has a length of between 2 feet and 8 feet when said flexible material is generally taut in between each of said framing supports.

4. The tunnel structure according to claim 1, wherein said flexible material is substantially air permeable.

5. The tunnel structure according to claim 1, further including a flap formed in said flexible material proximate each said means of ingress, capable of selectively covering each said means of ingress.

6. The tunnel structure according to claim 2, wherein said support means includes a base bracket that selectively joins to one of said side elements and supports it in a generally vertical orientation.

7. The tunnel structure according to claim 2 wherein said support means includes a means for rigidly coupling at least two of said framing supports together in generally vertical orientations.

8. The tunnel structure according to claim 1, wherein a decorative mural is disposed on said flexible material.

9. A toy tunnel play structure comprising:

a plurality of linear toy tunnel elements, each of said tunnel elements including:

a plurality of framing supports that define a central opening having a height and width of between 1.5 feet and 4 feet;

flexible, air permeable material tautly extending between at least two of said framing supports, defining a generally square tunnel element having a top surface, a bottom surface and two opposing side surfaces;

wherein said tunnel element extends linearly from a first end to a second end and includes a means of ingress at said first end, at said second end and at each of said opposing side surfaces through which a child can enter and exit said tunnel structure, wherein each of said means of ingress are generally uniform in size.

10. The play structure according to claim 9, further including means for selectively joining a first of said tunnel elements to a second of said tunnel elements wherein any means of ingress on the first of said tunnel elements is alignable with any means of ingress on the second of said tunnel elements, thereby enabling the first and second of said tunnel elements to create a continuous enclosure in one of a plurality of configurations.

11. The play structure according to claim 10 wherein said means for selectively joining a first of said tunnel elements to a second of said tunnel elements includes hook and loop fasteners.

12. The play structure according to claim 9, wherein a plurality of said means of ingress are disposed on each of said opposing side surfaces of each of said plurality of tunnel elements.

13. The play structure according to claim 9, wherein each of said plurality of tunnel elements has a predetermined length and each of said plurality of tunnel elements is selectively collapsible to a length substantially shorter than said predetermined length.

14. The play structure according to claim 9, wherein each of said plurality of tunnel elements has a decorative mural on said two side surfaces.

* * * * *